United States Patent [19]

Bookout et al.

[11] Patent Number: 4,563,131

[45] Date of Patent: Jan. 7, 1986

[54] VARIABLE DISPLACEMENT BLOWER

[75] Inventors: Charles C. Bookout, Niskayuna; Robert E. Stotts, Clifton Park; Douglass R. Waring, Ballston Spa, all of N.Y.; Lawrence R. Folsom, Ohain, Belgium

[73] Assignee: Mechanical Technology Incorporated, Latham, N.Y.

[21] Appl. No.: 605,480

[22] Filed: Apr. 30, 1984

[51] Int. Cl.[4] ..... F04B 1/06; F04B 29/00

[52] U.S. Cl. ..... 417/221; 417/462

[58] Field of Search ..... 91/494, 495, 497; 417/218, 221, 462; 418/166, 168, 265

[56] References Cited

U.S. PATENT DOCUMENTS

| | | | |
|---|---|---|---|
| 1,550,835 | 8/1925 | Morgan | 418/265 |
| 2,018,692 | 10/1935 | Waite | 417/462 |
| 2,221,501 | 11/1940 | Waite | 417/221 |
| 4,456,434 | 6/1984 | El Ibiary | 417/218 |

FOREIGN PATENT DOCUMENTS

| | | | |
|---|---|---|---|
| 1187578 | 3/1959 | France | 417/462 |
| 983135 | 2/1965 | United Kingdom | 417/462 |

*Primary Examiner*—John J. Vrablik

*Attorney, Agent, or Firm*—Joseph V. Claeys; Charles W. Helzer

[57] ABSTRACT

A blower having a stationary casing for rotatably supporting a rotor assembly having a series of open ended chambers arranged to close against the surrounding walls of the casing. Pistons are slidably mounted within each chamber with the center of rotation of the pistons being offset in regard to the center of rotation of the rotor assembly whereby the pistons reciprocate in the chambers as the rotor assembly turns. As inlet port communicates with the rotor assembly to deliver a working substance into the chamber as the pistons approach a top dead center position in the chamber while an outlet port also communicates with the rotor to exhaust the working substance as the pistons approach a bottom dead center position. The displacement of the blower is varied by adjusting the amount of eccentricity between the center of rotation of the pistons and the center of rotation of the rotor assembly.

8 Claims, 13 Drawing Figures

FIG. 1-A

VARIABLE DISPLACEMENT BLOWER

The Government of the United States of America has rights in this invention pursuant to Contract DEN3-32 awarded by the U.S. Dept. of Energy.

BACKGROUND OF THE INVENTION

This invention relates to a variable displacement blower and, in particular, to a blower having a displacement that can be varied without changing the blower speed. More specifically, this invention relates to a blower that is ideally well suited for use in conjunction with a Stirling engine.

The Stirling engine is a highly efficient external combustion engine that typically utilizes a pair of opposed pistons contained within a sealed cylinder. The pistons are operatively connected by means of a regenerator. Because the pistons are sealed within the cylinder, they require both an auxiliary source of heat and an auxiliary source of air in order to sustain the operation of the engine. Generally an air blower is utilized to bring ambient air into the high temperature sections of the engine in sufficient quantity to support fuel combustion. Many Stirling engines employ high speed centrifugal blowers for this purpose which are driven from the engine through a hydraulically controlled transmission which is more commonly referred to as a variator. A servomotor driven air throttle valve is also generally needed in conjunction with the blower in order to obtain fine control over the air supply as it moves into the engine. In any event, the auxiliary equipment is generally extremely complex and bulky and has proven to be difficult to maintain over extended period of time.

SUMMARY OF THE INVENTION

It is therefore a primary object of the present invention to improve blowers for pumping large volumes of a working substance, such as air, at relatively low pressures.

A further object of the present invention is to provide a blower whose displacement can be varied without having to change the blower speed.

A still further object of the present invention is to provide a light weight, low cost, blower that is capable of being controlled over a wide range of displacements while operating at a relatively low constant speed.

Yet another object of the present invention is to provide a variable displacement blower for use in conjunction with an external combustion engine which can be driven at engine speed without the need of a variator or an air throttle valve.

A still further object of the present invention is to provide a variable displacement blower than can be continuously controlled from zero to some maximum value without having to vary the speed of the blower.

These and other objects of the present invention are obtained by means of a blower having a rotor assembly mounted for rotation within a cylindrical compartment contained within a stationary casing. An inlet port and an angularly displaced outlet port are formed in the casing which communicate with the rotor compartment to allow a working substance such as air to pass therethrough. The rotor assembly contains a series of radially disposed open ended chambers, each of which slidably houses a piston. The outer end of each chamber is arranged to close against the wall of the rotor compartment and to open into each of the ports as the rotor turns about the axis of the compartment. Each piston is rotatably supported upon a shaft that is parallel with the axis of rotation of the rotor. The centerline of the shaft and the axis of rotation lie in a common plane and the linear distance between the two is adjustable so that the displacement of the pistons within the chambers can be varied without altering the speed of the blower. The rotor is coupled to a suitable drive means capable of turning the assembly at a desired operational speed.

BRIEF DESCRIPTION OF THE DRAWINGS

For a better understanding of these and other objects of the present invention reference is had to the following detailed description of the invention which is to be read in conjunction with the accompanying drawings, wherein:

FIG. 1A is an end view along the line A—A of FIG. 1;

DESCRIPTION OF THE INVENTION

Figure 1:
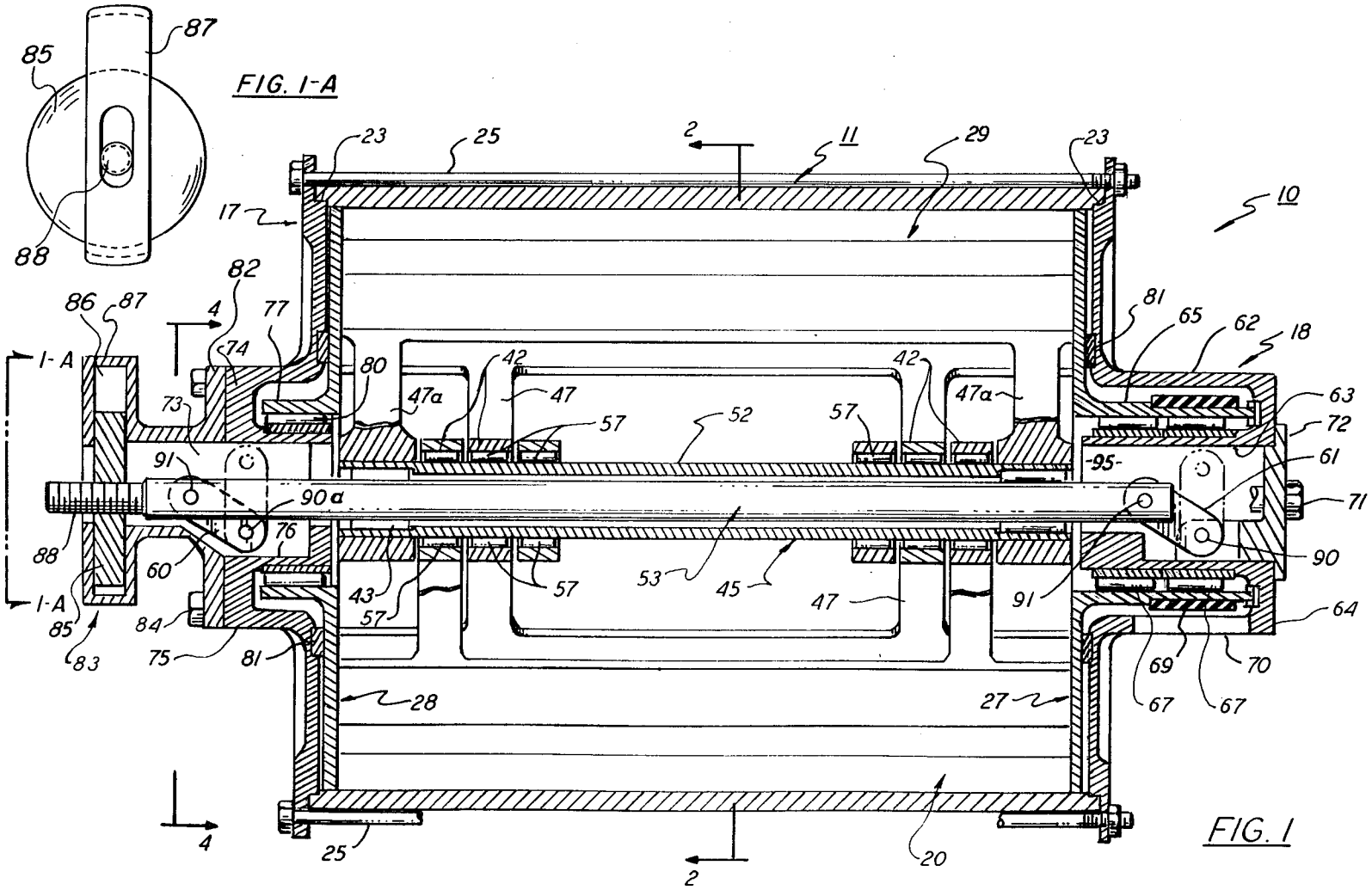
FIG. 1 is a side elevation in section showing a blower embodying the teachings of the present invention.
Figure 2:
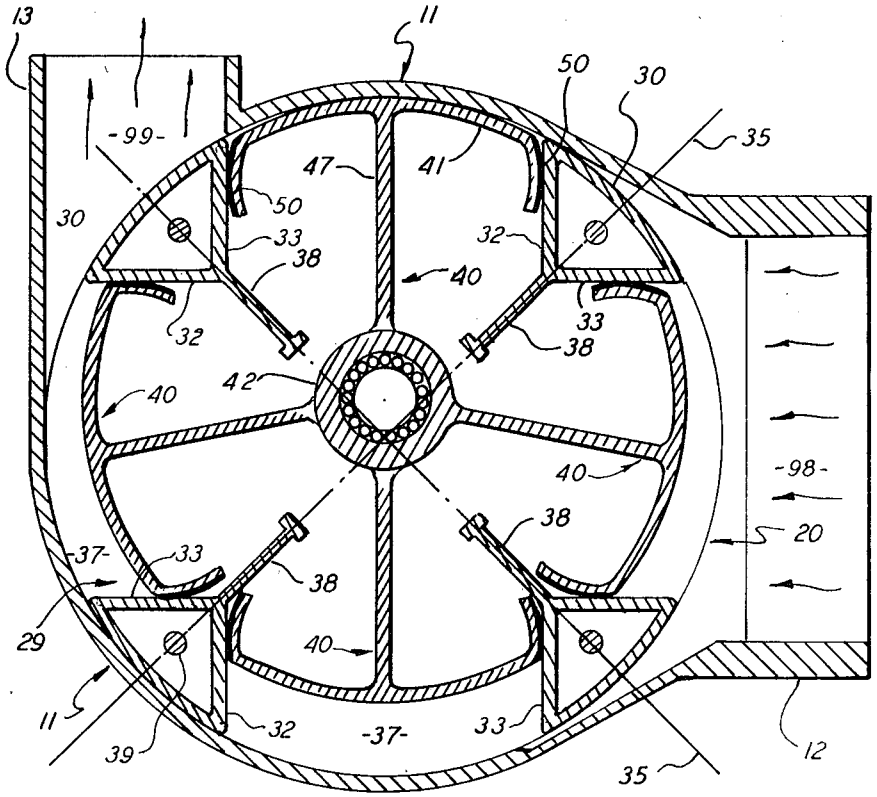
FIG. 2 is an enlarged sectional view taken along lines 2—2 in FIG. 1.
Figure 3:
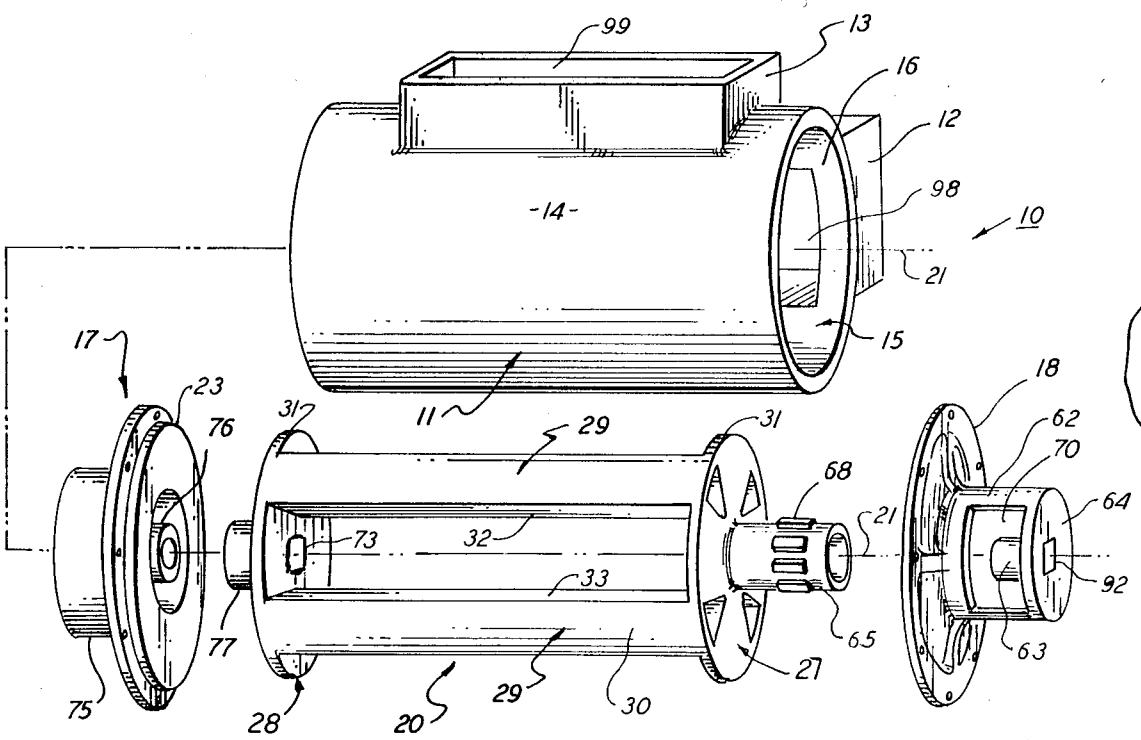
FIG. 3 is an exploded view in perspective showing portions of rotor assembly and the blower casing of the present invention.

Turning now to the drawings and, in particular, to FIGS. 1–3, there is illustrated a positive displacement blower, generally referenced 10 that is capable of delivering varying volumetric rates of flow of a working substance, such as air, without having to alter the speed of the blower. The present blower can be employed in conjunction with a constant speed driver or prime mover in applications where the blower is required to deliver varying output flow rates. One such application is in a Stirling engine which has no inherent air pumping capabilities. In this application the blower can be belt driven directly from the engine and the displacement of the blower altered to meet the engine demands without regard to the engine speed. As will become apparent from the disclosure below, continuous variations in the blower's displacement can be achieved at almost any speed without the need of a variator, air throttle valve or high pressure oil system.

FIGS. 1–3 depict a blower 10 that is well suited for bringing combustion air to the hot engine sections of a Stirling engine. The blower includes a one piece metal casing 11 having a cylindrical shaped rotor compartment 15 passing laterally therethrough which rotatably houses a rotor assembly 20 for delivering air to the engine. A horizontally disposed inlet section 12 and a vertically disposed outlet section 13 depend from the main body section 14 of the casing. The inlet section houses an elongated inlet port 98 which communicates with the rotor compartment and furnishes ambient air to the rotor assembly. The outlet section houses a similar elongated discharge port 99 that serves to direct the discharge flow from the rotor assembly to the engine. It should be noted that both ports are clear channels and unlike many positive displacement devices such as reciprocating pumps and the like do not require valves to control the flow of air into and out of the blower.

The interior wall 16 of the rotor compartment is machined to a smooth finish against which the sliding surfaces of the rotor assembly can turn with a close running fit. The rotor compartment is closed at both ends by means of annular end walls 17 and 18. Each end wall contains a circular lip 23 formed on its inside wall that is adapted to fit snugly into the rotor compartment so that the end walls, in assembly, are centered upon the axis 21 of the rotor compartment. External studs 25—25 pass through co-aligned holes 26—26 formed about the outer rim of the walls. The studs are bolted in place to draw the walls lightly against the casing to provide a leak-tight joint therebetween and to hold the walls in place under normal operating conditions.

The rotor assembly 20 includes an open cage-like unit of cylindrical construction which is formed, using any well known fabricating technique, of a single piece of metal having good bearing or wear resistant characteristics. The rotor assembly includes a pair of circular end plates 27 and 28 that are cojoined by a plurality of axially extended triangular shaped partitions generally referenced 29—29. The partitions are circumferentially spaced at equal intervals about the outer periphery of the circular end plates. The outer wall 30 of each partition is arcuate shaped and complements the outer periphery 31 of the two end plates as best illustrated in FIG. 3. Accordingly, the outer surface of the rotor describes a cylinder which, when mounted within the smooth walled rotor compartment, provides the previously noted close running fit between the two elements. The rotor assembly is supported in the end walls of the casing so that it turns about the axis 21 of the compartment whereupon the outer walls 30—30 of the partitions move in close sliding relationship against the wall 16 of the compartment.

Each partition further includes a pair of inclined sidewalls 32 and 33 that also extend axially between the end plates and form an integral part of the rotor structure. The sidewalls are of equal length and are inclined inwardly at the same angle so that the walls intersect at a diametrical line 35 that bisects the outer wall 30 of the partition. As best illustrated in FIG. 2, due to this construction, the opposing sidewalls of adjacent partitions, that is, walls 32 and 33, are parallel. The adjacent partitions thus cooperate to establish a series of open ended chambers 37—37 about the rotor assembly; the chambers being equal in number to the number of partitions used. An axially disposed stiffening bar 38, which also forms an integral part of the rotor structure, is mounted immediately below each partition to help reinforce the assembly and prevent it from deforming under load. The stiffening bars are again centered upon the diametrical lines 35—35 that bisect the partitions. When a multi-piece rotor is employed, tie rods 39—39 are provided and mounted between the end plates within the partitions to provide added strength to the structure.

As further illustrated in FIG. 2, a piston unit, generally depicted at 40, is slidably contained in each of the chambers 37—37. Each unit includes a piston body 41 which is rectangular in form and which substantially fills the area of the chamber between its wall. The piston body is, in turn, attached to a bearing hub 42 by means of a pair of axially offset connecting arms 47—47. The piston units are rotatably supported upon a common shaft assembly 45 that is made up of a central shaft 53 and an exterior sleeve 52. The sleeve is rotatably supported upon the shaft by means of a pair of outboard roller bearing 43—43. In assembly, the shaft passes through openings provided in the rotor end plates while the sleeve is positioned inside the plates as shown in FIG. 1.

The connecting arms 47—47 of the piston units are each secured to the shaft sleeve with the arms being super-imposed one inside the other along the length of the sleeve. One outboard arm **47*a* is press fitted on to the sleeve immediately over the end bearings 43—43 whereby the sleeve is caused to turn with the associated piston. The interior connecting arms associated with the remaining piston units are rotatably supported upon the sleeve by means of roller bearings 57—57**. As can be seen, each of the piston units is free to turn about the axis or centerline of the shaft assembly as they are driven over a circular path of travel by the rotor assembly.

Any suitable means may be used to seal the piston bodies against the chamber walls to provide a sliding leak-tight joint therebetween to prevent air from passing between the two members. The piston bodies are manufactured to a close tolerance to maintain a close running tolerance. The rubbing surfaces of the piston body are coated with a compatible sealing material 50 (FIG. 2) which minimizes friction and wear. The seal can be bonded to the piston face or secured thereto by any suitable means. For example, the piston can be made from plastic or other moldable or extrudable materials with seal being integrated into the piston body during the molding or extruding process. Similarly, the pistons can be made slightly oversized of a material having good bearing properties. The deformation required to assembly the piston body within the chamber will result in a mechanical preloading of the piston upon the sealing surfaces. This preloading will enable the piston to maintain contact with the chamber walls over the working range of the piston and will also be self compensating in terms of wear.

The shift assembly is movably contained within the two end walls 17 and 18 of the blower by means of a pair of control links 60 and 61. The right hand end wall 18, as viewed in FIG. 1 includes an outer hub 62 which houses a depending bearing flange 63 that is attached to the hub by an end wall 64. The bearing flange contains an opening 95 that passes axially therethrough. The end of shaft 53 and control link 61 are both movably contained in the housing. The opening is closed by an end cap 72 that is tightly bolted in place.

The bearing flange passes into the hub to about the full depth of opening 95. The end plate 27 of the rotor assembly is provided with an axial extended axle 65 that, in assembly, is arranged to pass over the internal flange 63 of the adjacent end wall 18 in coaxial alignment therewith. A pair of thrust bearings 67—67 are mounted between the two superimposed cylindrical members which enables the rotor to turn about the axis of the rotor compartment. A timing pulley 68 (FIG. 3) is mounted or formed in the axle. The pulley is adapted to mate with a timing belt 69 that passes through the end wall hub 62 via an opening 70 furnished for this purpose. Although not shown, the timing belt may be directly connected to the engine so that the rotor assembly turns continuously at engine speed.

The opposing end wall 17 of the casing is also provided with an outer hub 75 that houses a second bearing flange 76 secured to the hub by an end wall 74. The end plate 27 of the rotor assembly supports an extended cylindrical bearing housing that passes over the bearing flange 76 in coaxial alignment therewith. A roller bearing 80 is operatively supported between the two superimposed members. The bearing rotatably supports the left hand end of the rotor assembly within the casing. Annular face seals 81—81 are carried in receiving grooves formed in the inside walls of the two end walls. The seals ride in sealing contact against the outside surfaces of the rotor end plates to prevent air from passing therebetween.

As illustrated in FIG. 1, the control links 60 and 61 are rotatably supported in end walls 17 and 18, respectfully, by means of pivot 90 and 90*a*. Link 60 is secured to pin 90*a* so that the link and pin turn as a unit about the axis of the pivot. The opposite end of each link is movably contained within a slot 79 (FIG. 4) cut in the shaft by means of a pin 91. The shaft and the control links form a four bar linkage that regulates the motion of the shaft within a plane in which the control links swing.

A stroking mechanism, generally referenced 83 is secured to the end face of end wall 17 by means of a bolting flange 82 and series of bolts 84—84. A housing 87 is contained at the rear of the mechanism.

The end 88 of shaft 53 extends through a suitable opening in housing 87 which will allow the end of the shaft to move both axially and vertically with the plane of motion prescribed by the four bar linkage. To conveniently effect the desired movement of shaft 53, a knurled nut 85 is provided which engages suitable threads at the end 88 of shaft 53. As shown more clearly in FIG. 1-A, the nut 85 extends beyond the sides of housing 87 so as to be readily rotated manually. Manual rotation of nut 85 on the threaded end 88 causes shaft 53 to move both axially and vertically with the plane of motion prescribed by the four bar linkage.

The plane of motion described by the four bar linkage is arranged in the present invention to pass through the fixed axis of rotation of the rotor assembly. Accordingly, as the shaft is repositioned by the stroking mechanism the shaft will move through a linear path of travel toward or away from the rotor axis of rotation. The amount of eccentricity (E) between the centerline of the shaft and the axis of rotation of the rotor can be varied when the rotor is turning.

Figure 4:
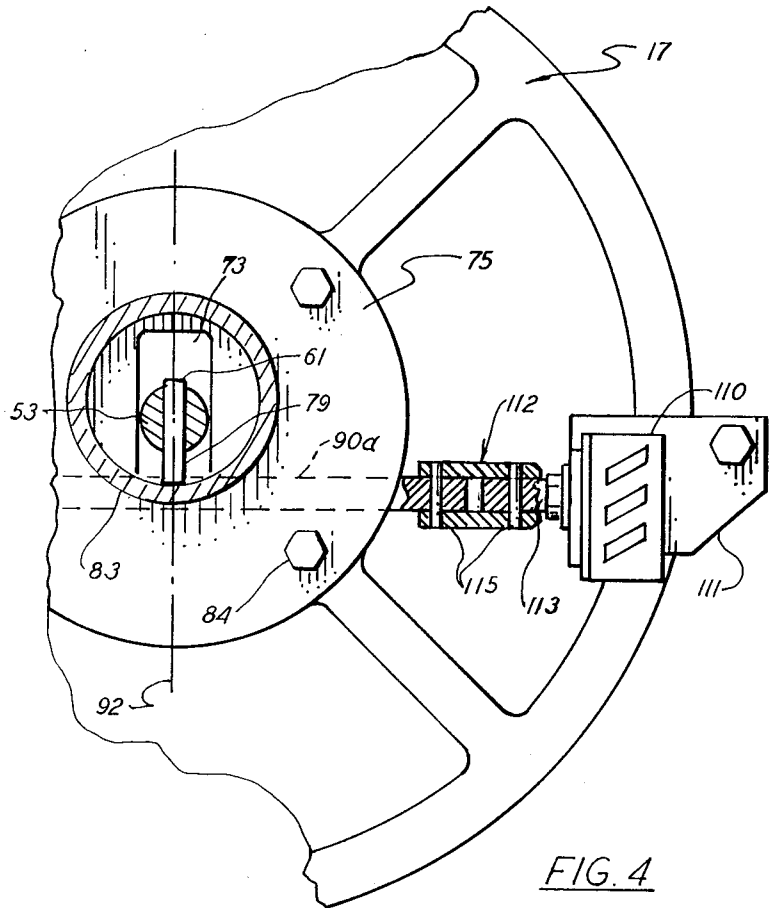
FIG. 4 is a sectional view taken along lines 4—4 in FIG. 1.
Figures 11, 12:
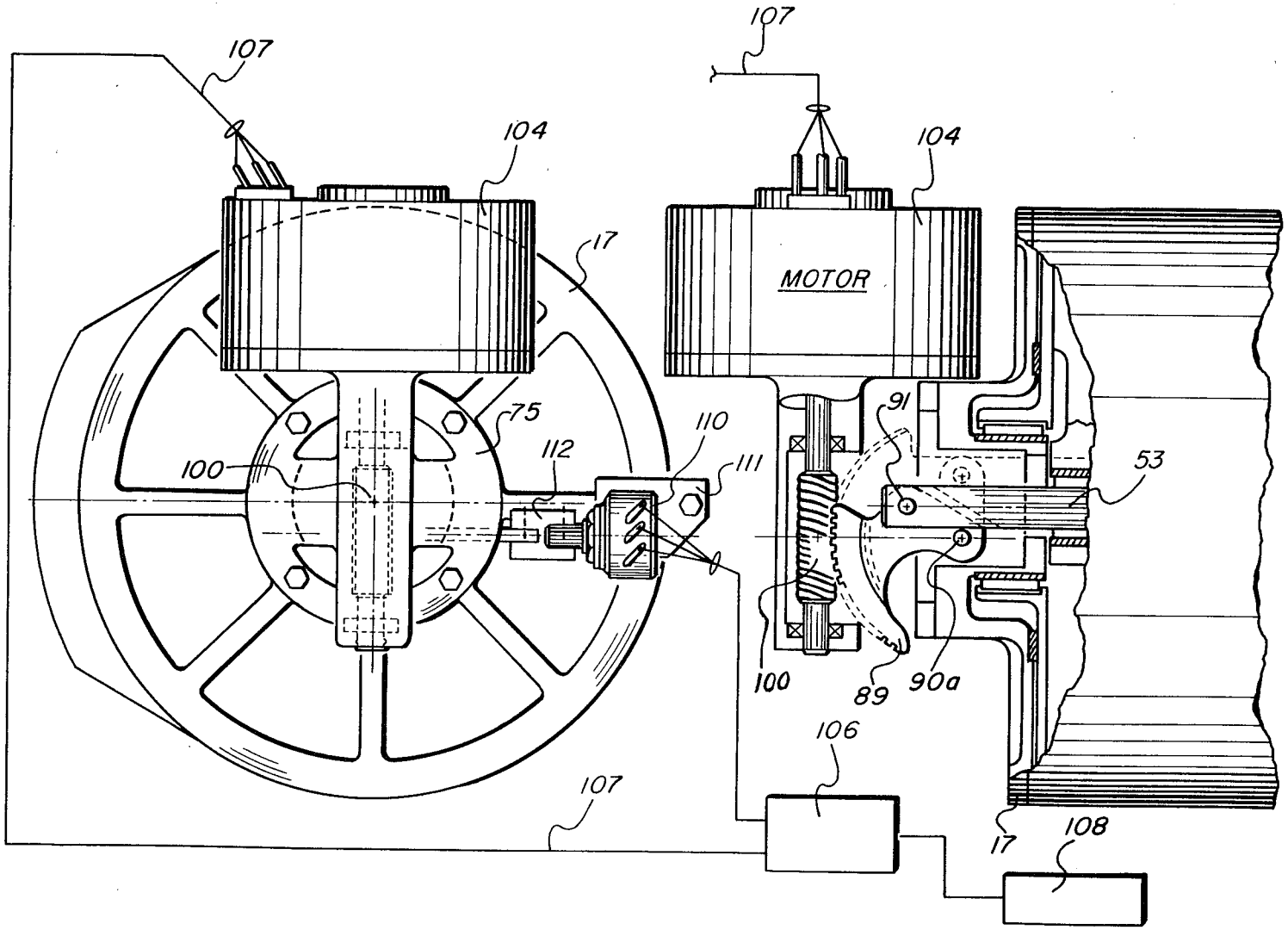
FIG. 11 is a schematic representation of a control system for the blower of this invention.
FIG. 12 is an end view of the blower of FIG. 11.

An automatic stroking and control means is illustrated in FIGS. 11 and 12. As shown in FIG. 11, a sector gear 89 is connected with the end of shaft 53. Sector gear 89 is arranged to be driven by a worm gear 100. Worm gear 100 may be driven from any suitable means, shown as an indexing motor 104. Motor 104 is operatively connected with a comparator 106 via line 107. The comparator is arranged to receive a control signal input from controller 108 and compare this input with a second input provided by potentiometer 110. As shown more clearly in FIG. 4, the potentiometer is secured to the end wall 17 of the casing by means of a bracket 111 and is connected to the pivot 90*a* by means of a sleeve connector 112. The connector as shown in FIG. 4 is pinned to both the pivot 90*a* and the shaft 113 of the potentiometer by pins 115—115 so that the potentiometer can electrically sense the position of the pivot and thus the position of the shaft as it is being displaced by the stroking mechanism. The potentiometer provides a sensing signal to the comparator that is indicative of the shaft position. This signal is compared to the control signal and the indexing motor is incremented until the desired shaft setting is reached.

Figure 6:
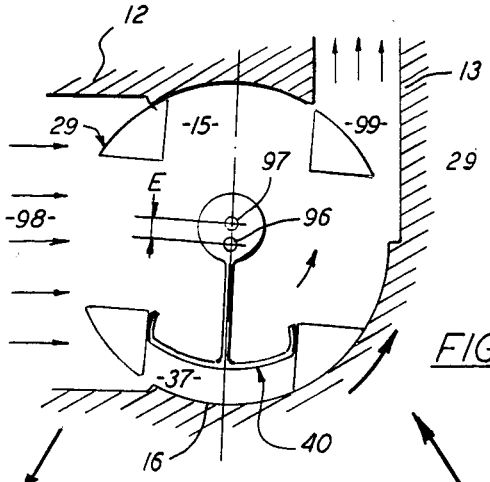
FIGS. 6–10 are schematic representations of the present blower showing the displacement pattern of a piston as it moves through one complete pumping cycle.

The operation of the blower will be explained in greater detail with reference to FIGS. 6–10 which schematically outlines the movement of one piston unit 40 as it is driven by the rotor assembly through one complete pumping cycle. The axis of the rotor assembly passes through center 96 while the axis of the shaft assembly passes through center 97 (FIG. 6). Through means of the stroking mechanism the eccentricity (E) between the two centers is preset to control the displacement of the blower. The plane of motion between the two centers is depicted by the line 92 which passes through the casing.

Initially, as depicted in FIG. 6, the piston 40 is raised to a maximum displacement position within the chamber at about the time the chamber leaves the inlet port region where upon the two partitions close against the interior wall 16 of the rotor compartment 15. Air that has been drawn into the chamber is thus trapped within the fully expanded chamber.

Figure 7:
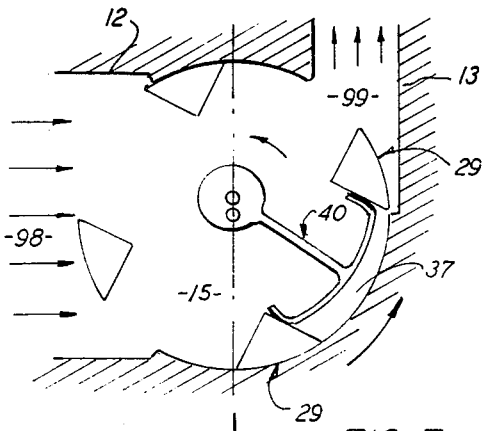

As the rotor assembly continues to turn about center 96, the piston begins to move down the chamber to reduce the volume of the chamber and compressing the air trapped therein. As seen in FIG. 7, the chamber now begins to open into the discharge post and the entrapped air, acting under the influence of the moving piston is pumped out of the chamber into the discharge port. Sufficient compression is generated in the chamber to overcome the pressure in the discharge port thus insuring that the air is released from the chamber. The piston continues to move down as the chamber is rotated through the discharge region thereby driving the trapped air from the chamber.

Figure 10:
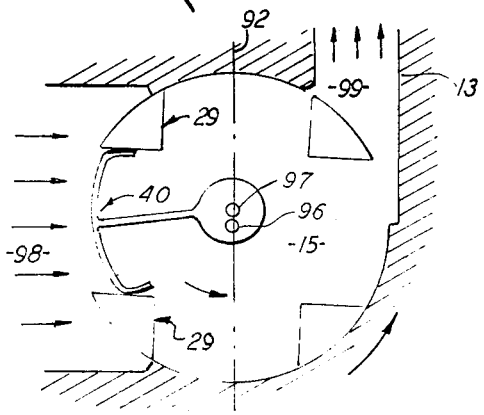
Figure 8:
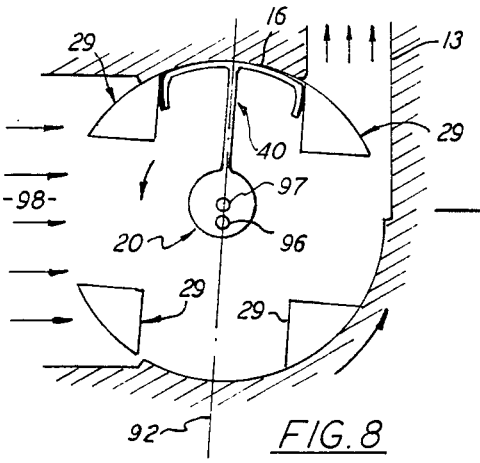
Figure 9:
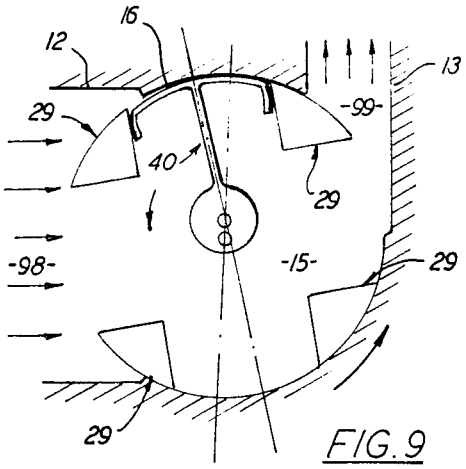

As illustrated in FIG. 8, the piston reaches its full stroke position at about the same time that the chamber once again closes against the rotor compartment wall. As the rotor swings past the bottom dead center position the piston once again begins to move back in the chamber and the chamber opens into the air inlet port 98 as shown in FIG. 9. The piston continues to move back as the rotor moves through the air inlet region as shown in FIG. 10 until such time as the chamber closes against the wall of the rotor compartment to complete the cycle. The piston reaches its top dead center position at about the time the chamber closes against the rotor compartment wall as shown in FIG. 6.

As should be evident from the present disclosure, the displacement of the blower can be changed as the rotor assembly is turning by simply adjusting the position of the piston support shaft within the plane of motion 92. It should be further noted that a number of pistons, in this case four, are simultaneously pumping as the rotor is turning within the casing. The area of each rectangular piston is also relatively large. A slight adjustment of the shaft position will produce a relatively large change in the output displacement of the blower. Accordingly, through use of the stroking mechanism rapid and fine control over the blower can be continuously maintained regardless of the speed of which the rotor is turning.

Figure 5:
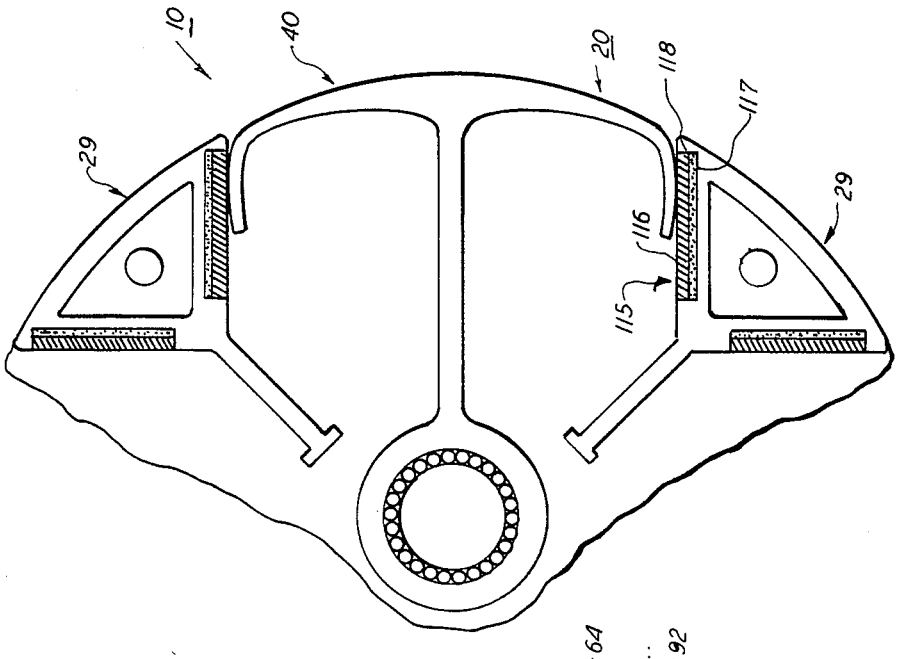
FIG. 5 is a partial end view in section similar to FIG. 2 showing an alternative means for sealing the chambers of the blower.

FIG. 5 further illustrates an alternative embodiment of the invention wherein the piston mounted seals shown in the main embodiment of the invention are replaced with wall mounted seals. As shown, compliant seals 115 are mounted in the sidewalls and end wall of each chamber. The compliant seals each include an outer pad 116 of suitable bearing material that is adapted to ride in sealing contact against the peripheral walls of piston 40 to prevent air from passing therebetween. A spring biasing backing member 117 is placed behind the pad which urges the pad outwardly into conforming contact with the adjacent piston structure. The pad and backing member form a unit which, in assembly, is carried in a slotted opening piston 118 formed in the piston opposing wall of the chamber.

While this invention has been described with specific reference to the details as set forth above, it is not intended to be limited to this specific structure and the invention is intended to cover any modifications or changes that may come within the scope of the following claims.

We claim:

1. A variable blower for moving a working substance that includes a casing having an elongated cylindrical compartment and an inlet and outlet port circumferentially displaced in the wall of compartment a cylindrical rotor unit rotatably mounted within the compartment having a plurality of axially extended piston chambers formed therein, said rotor unit being coaxially aligned with said compartment, a rectangular shaped piston mounted in each of the piston chambers for rotation therewith, an axially disposed shaft mounted in said casing compartment to which each piston is connected, mounting means for movably supporting both ends of the shaft within the casing so that said shaft can move within the compartment toward and away from the axis of the rotor unit along a radial line of the compartment, means for sensing the position of the shaft in relation to the axis of the rotor, and adjusting means responsive to the sensing means for changing the position of said shaft whereby the displacement of the blower can be controlled.

2. The variable blower of claim 1 further includes removable end disc mounted in the casing between which the rotor unit is suspended.

3. The variable blower of claim 1 that includes sealing means acting between the pistons and the piston chambers to minimize the loss of working substance therebetween.

4. A variable displacement blower for moving air that includes a stationary casing having an axial length greater than its diameter and having a cylindrical compartment formed therein which communicates with an inlet port for admitting air into the compartment and an angularly offset outlet port for discharging air from said compartment, a cylindrical rotor extending throughout and supported in said compartment for rotation about the central axis of said compartment, said rotor including a pair of circular end discs that are cojoined by a plurality of axially extended partitions that are equally spaced about the circumference of the discs, each of the said partitions having a circular outer wall that rides in sliding contact against the circular wall of said compartment and a pair of inwardly disposed sidewalls that intersect at one of the radial lines of said rotor means which bisects the outer wall of the partition whereby the opposing walls of adjacent partitions are parallel and coact to form radially disposed chambers, a rectangular piston extending axially throughout and slidably contained within each of the said chambers, a shaft means for rotatably supporting each piston, the centerline of the shaft means lying in a common plane with the axis of the rotor and being linearally offset from the said axis whereby the pistons are displaced in the chambers as the rotor turns about said axis, said common plane lying between the inlet port and outlet port of the casing so that the volume of each chamber approaches a maximum value as the chamber moves through the inlet port and a minimum value as it moves through said outlet port, drive means for turning the rotor within said casing, and adjusting means including a four bar linkage arrangement for effecting axial and vertical movement of said shaft means for varying the linear distance between the centerline of the shaft means and the axis of the rotor to vary the displacement of the piston within the chambers.

5. The blower of claim 4 that further includes seal means acting between the pistons and the chamber wall to minimize the loss of air from the chambers.

6. The blower of claim 4 wherein said rotor means contains an even number of chambers equally spaced about the circumference of said discs.

7. The blower of claim 4 that further includes a central means for sensing the linear displacement of the shaft means and the axis of the rotor and regulating the adjusting means in response thereto to vary the displacement of the blower.

8. The blower of claim 4 that further includes a series of stiffening member centrally positioned along the radial lines bisecting said partitions, said member extending axially between the discs of the rotor.

* * * * *